United States Patent [19]

Scheurecker et al.

[11] Patent Number: 4,603,841

[45] Date of Patent: Aug. 5, 1986

[54] LADLE SUPPORT MACHINE

[75] Inventors: Werner Scheurecker; Alois Scheinecker, both of Linz, Austria

[73] Assignee: Voest-Alpine International Corporation, New York, N.Y.

[21] Appl. No.: 620,880

[22] Filed: Jun. 14, 1984

[51] Int. Cl.[4] ..... C21B 3/00

[52] U.S. Cl. ..... 266/44; 266/78; 266/276; 164/437

[58] Field of Search ..... 266/78, 92, 86, 276, 266/236, 99, 240; 164/437, 438; 222/591, 607

[56] References Cited

U.S. PATENT DOCUMENTS

| | | | |
|---|---|---|---|
| 3,817,318 | 6/1974 | Greenberger et al. | 164/438 |
| 3,894,576 | 7/1975 | Schoffmann | 164/438 |
| 4,286,738 | 9/1981 | Blum | 222/591 |

FOREIGN PATENT DOCUMENTS

| | | |
|---|---|---|
| 0017696 | 6/1983 | European Pat. Off. . |
| 2158902 | 8/1979 | Fed. Rep. of Germany . |

*Primary Examiner*—L. Dewayne Rutledge
*Assistant Examiner*—S. Kastler
*Attorney, Agent, or Firm*—Horst M. Kasper

[57] ABSTRACT

A support machine is provided for a ladle in a continuous casting. A rotatable column is positioned on a bearing on a foundation base. A ladle support arm is pivoted around a horizontal axis, includes a yoke surrounding the rotatable column and has a U-shaped planar projection, and two lever legs running about in parallel and each extending an end of the yoke. A ladle support is disposed near an end of each lever leg. A support provision for each lever leg is disposed between the ladle support and the yoke for supporting the lever leg on the side of the column disposed toward the corresponding ladle. A position adjustment provision is attached to the column, is disposed at the side of the column opposite to the corresponding support provisions and engages the yoke. A ladle support is disposed near the free end of the support arm and can be pivoted around a horizontal axis provided by a hinge mechanism. An inclination measurement sensor is disposed at the ladle support of the ladle support arm. A control provision is connected to the inclination measurement sensor and a setting provision for the ladle support fed from the sensor maintains the ladle support in a desired position.

25 Claims, 5 Drawing Figures

LADLE SUPPORT MACHINE

BACKGROUND OF THE INVENTION

1. Field of the Invention

The present invention relates to a ladle support tower for a continuous casting plant with two oppositely directed support arms tiltably disposed around a horizontal axis, which ladle supports are provided at the ends of the support arms.

2. Brief Description of the Background of the Invention Including Prior Art

A ladle support tower for a continuous casting plant is known from the German Patent Document DE-B-No. 2,158,902 where the support arms are formed as one leg levers. Each support arm is hinged around a horizontal axis with one end disposed toward a column, and the support arm can be pivoted with a hydraulic pressure cylinder provided at about the middle of the length of the support arm between the hinge axis and the ladle support provided at the other end. Therefore, the hydraulic pressure cylinder has to be capable of lifting up and lowering down a weight of double the weight of the ladle.

In order to avoid the requirement of such overdimensioning of the devices employed two-armed levers have been employed for this purpose. A ladle support tower with support arms provided as two-armed levers of the kind described above is known from European Patent Document EP-B-No. 0017696. The support arms provided at this ladle support tower are furnished with two forked arms providing the work arms, which are joined by a cross-rail, where a power arm starting at the cross-rail protrudes to the middle of the column. The free end of the load arm is supported at a cross-traverse joined at the upper column part by hydraulic cylinders.

This construction is associated with the disadvantage that the cross girder is loaded with a high torque and therefore it has to be constructed torsion-proof. In addition, the power arm can be made only with a very short length which entails that the power arm has to be actuated with a force, which is substantially larger than the force of the weight of the ladles. The hydraulic pressure cylinder used to actuate the power arm therefore has to be overdimensioned. The cross girder connecting the force arms has to be capable of accepting a large bending moment, which results from the loading with the hydraulic pressure cylinder or, respectively, with the weight of the ladle with contents.

It can be considered a further disadvantage of the conventional constructions that the cross-girder requiring larger outer dimensions for this purpose can only with difficulty be pivotably supported in closed bearing provisions. Therefore, the cross girder is supported by bearings at the column, which bearings are open at the top, which is a disadvantage in view of the the rough casting operations. A mounting and demounting of a support arm for repair purposes or for maintenance of the bearing positions is difficult because of the cross-traverse spanning at the top end of the column, since it interferes with the accessibility to the hydraulic pressure cylinders.

SUMMARY OF THE INVENTION

1. Purposes of the Invention

It is an object of the present invention to provide a ladle support tower, where the support arms can be assembled and disassembled from the tower in a simple way, where the bearing support positions are easily accessible and where for the strength required dimensioning only the weight of the ladle has to be considered and where overdimensioning of components such as hydraulic cylinders are avoided.

It is another object of the present invention to avoid components subjected to torque loads at the support arms such that the support arms have themselves a weight as low as possible.

It is a further object of the present invention to provide a ladle support system which allows for controlled moving and spacial directing of the ladle support.

These and other objects and advantages of the present invention will become evident from the description which follows.

2. Brief Description of the Invention

The present invention provides a ladle support tower for a continuous casting plant which comprises a rotatable column, a ladle support arm pivoted around a horizontal axis and including a yoke surrounding the rotatable column and have a U-shaped planar projection, and two lever legs running about in parallel and each extending to an end of the yoke. A ladle support is disposed near an end of each lever leg. A support provision for each lever leg is disposed between the ladle support and the yoke for supporting the lever leg on the side of the column disposed toward the corresponding ladle. A position adjustment provision is attached to the rotatable column, is disposed at the side of the column opposite to the corresponding support provisions and engages the yoke.

The support provision can include a platform attached to the column, a bearing mounted to the platform, and a bearing pin rigidly attached at the lever leg, which bearing pin is rotatably disposed at bearings mounted at a platform of the column. The support provision can include a platform attached to the column, a bearing mounted to the lever leg, a bearing pin rigidly supported at the platform, passing through in each case a lever leg, and supported by the bearing mounted to the lever leg.

Two ladle support arms can be provided such that the lever legs can be disposed about in parallel. The support provision can include a platform for each ladle support arm, where the platforms are disposed at about the same horizontal level, where one of the ladle support arms has the yoke angled upwardly versus the respective lever leg plane, where a second of the support arms has the yoke angled downwardly versus the respective lever leg plane, where the downwardly angled yoke is movable in a free space provided at the column between two column parts forming the platforms for the support provision of the upwardly angled yoke. The downwardly angled ladle support arm can be actuated with a position setting provision disposed above the yoke. The upwardly angled ladle support arm can be actuated with a position setting provision disposed above the arm. The upwardly angled ladle support arm can be actuated with a position setting provision disposed below the arm.

Each support provision can include a platform for each ladle support arm, the platforms can be disposed at about the same horizontal level, and a recess can be provided in the column to provide space for the movement of the yokes. Setting provisions of the ladle support can be disposed near an end of the lever leg, an inclination measurement sensor can be disposed at one ladle support of the ladle support arm, which is connected via a control provision to the setting provisions of the ladle support. The setting provisions can include a hydraulic pressure cylinder. The setting provisions can be disposed inside of hollow recesses of the support arms. An extension can be provided at the ladle support, where the free end of the extension is hinged to the setting provision.

There is also provided a ladle support tower for a continuous casting plant which comprises a support column, a support arm disposed at the column and tiltable around a horizontal axis, a hinge mechanism disposed at the support arm, ladle supports for a ladle disposed near the free end of the support arm and tiltable around a horizontal axis provided by the hinge mechanism, an inclination measurement sensor disposed at the ladle support of the ladle support arm, a control provision connected to the inclination measurement sensor, and setting provision for the ladle support connected to the control provision for maintaining the ladle support in a desired position.

The setting provision can include a hydraulic pressure cylinder. The setting provision preferably is disposed inside of a hollow recess of the support arm. An extension can be provided at the ladle support, where the free end of the extension is hinged to the setting provision. A support provision can be disposed at the column for the support arm to allow for pivoting of the support arm around a horizontal axis. A position adjustment provision can adjust the position of the support arm. Control means can be connected to the position adjustment provision to actuate the position adjustment provision. Coordinating means can coordinate the control means and the control provision for coordinating a change in spacial location of the ladle support to a change in the alignment direction of the ladle support relative to the column.

A rotary bearing can be furnished for the support column for allowing rotation of the support column around a vertical axis relative to the foundation base. A control device can actuate a rotation of the column. Coordinating means can coordinate the control means, the control provision and the control device for relating a change in spacial location of the ladle support to a change in the alignment direction of the ladle support relative to the foundation base.

There is further provided a method for operating a ladle at a ladle support tower in a continuous casting plant which comprises sensing the inclination of a ladle support disposed at a ladle support arm with an inclination measurement sensor, feeding the signal from the inclination measurement sensor to a control provision, and actuating a motion of the ladle support with the control provision.

Fluid can be moved in a pressure cylinder to provide for actuation of the ladle support around a hinge mechanism. A signal can be fed to a control means for actuating a position adjustment provision. The support arm can be rotated, which arm is disposed at a ladle support column, around a horizontal axis with the position adjustment provision. The control means and the control provision can be coordinated with a coordinating means for relating a change in spacial location of the ladle support to a change in the alignment direction of the ladle support relative to the column.

A control signal can be fed to a control device and the support column can be rotated relative to a foundation base around a vertical axis and actuated by the control device. The control means, the control provision and the control device can be coordinated for relating a change in spacial location of the ladle support to a change in the alignment direction of the ladle support relative to the foundation base with a coordinating means.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
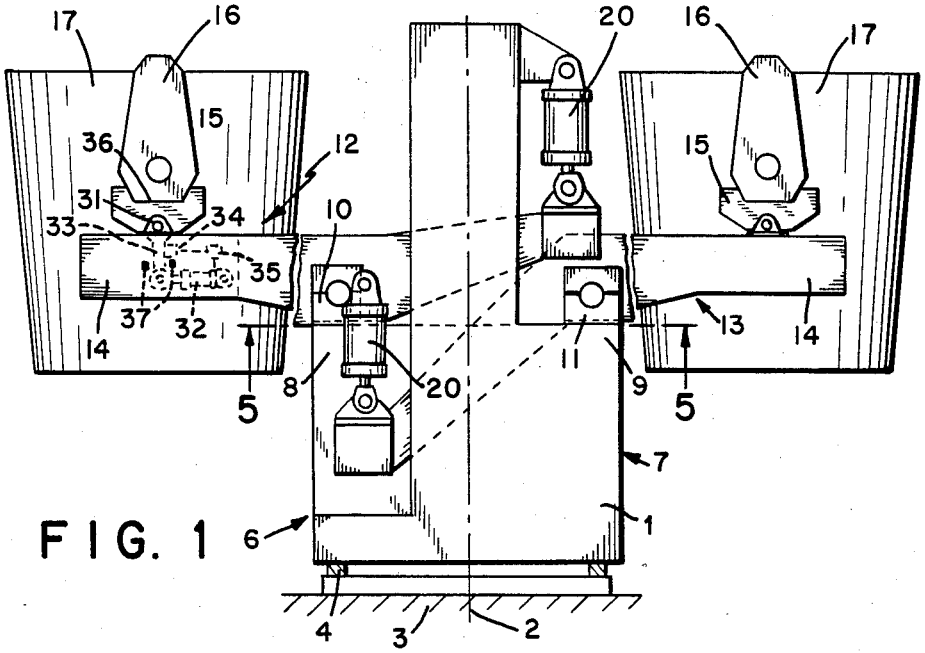
FIG. 1 is an elevational view of a schematic representation partially in section of a ladle support tower.

In accordance with the present invention there is provided a ladle support tower for a continuous casting plant with two support arms 12, 13 disposed at a rotatable column 1, pivoted around a horizontal axis, and directed in opposite directions relative to each other. Ladle supports 15 for a casting ladle 17 are provided at the ends 14 of the arms. The support arms 12, 13 are provided as two-arm levers and are tiltably disposed with position adjustment provisions 20 disposed at the column 1. Each support arm 12, 13 is formed of two legs 18 and a yoke 19 surrounding the column 1, having U-shaped cross-section and connecting the legs 18. Each leg 18 is supported between the ladle support 15 and the yoke 19 with its own bearing support position 10, 11 at the side 6, 7 of the column 1 disposed toward the ladle support 15. The position adjusting provision 20 for the support arms 12, 13 is hinged at the opposite side 7, 6 of the column 1 as well as at the yoke 19.

Figure 3:
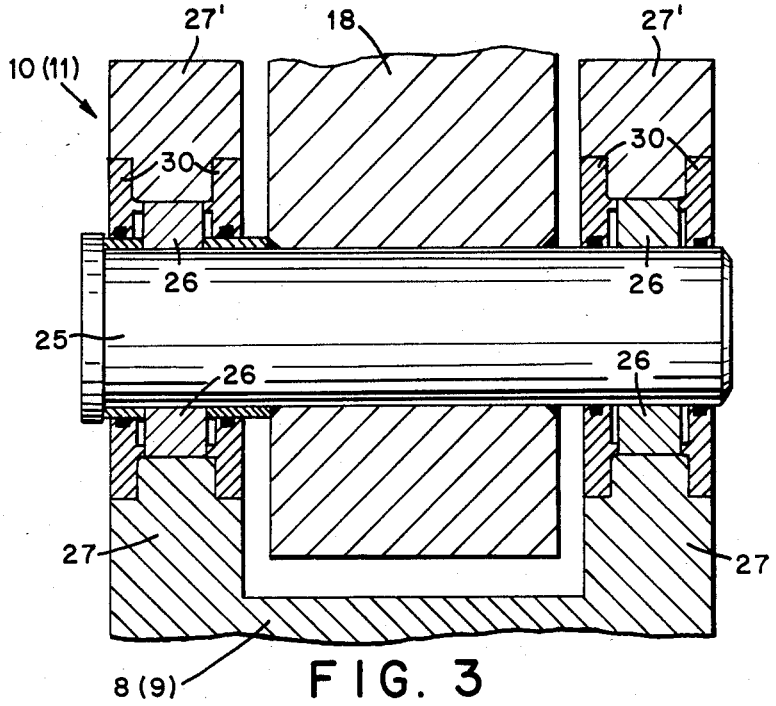
FIG. 3 is a sectional view along section line III—III of FIG. 2 at an enlarged scale.

As shown in FIG. 3, a bearing support position 10, 11 can be formed by a bearing pin 25 rigidly attached to the leg 18, which bearing pin 25 is pivotably supported at bearings 26 mounted at a platform 8, 9 of the column 1. This construction results in a bearing where the bearing elements can be mounted and demounted in a particularly simple way.

Figure 4:
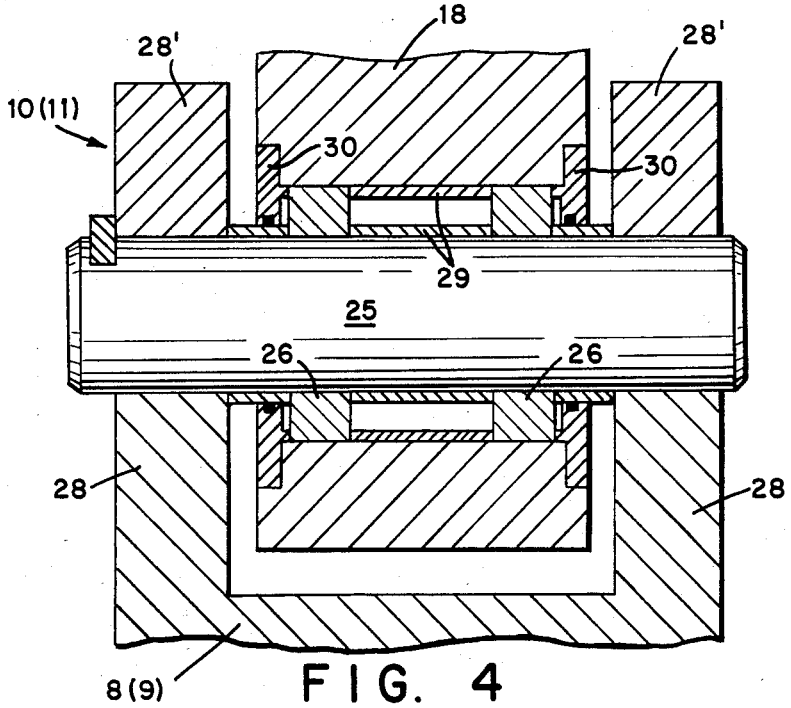
FIG. 4 is a sectional view of another embodiment illustrated in the same manner as FIG. 3.

One bearing support position 10, 11 can be alternatively formed according to FIG. 4 by a bearing pin 25 rigidly supported at a platform 8, 9 of the column 1 based on attachment means 28, 28'. The bearing pin in each case passes through a leg 18 and is supported versus the support leg by at least one bearing 16. This is a particularly tough and reliable construction of a ladle support tower.

The bearing support provisions 10, 11 of the two platforms 8, 9 receiving the two support arms 12, 13 can be disposed at about the same horizontal level 5 and one support arm 12 can be provided as an lever angled upwardly. Having the platform at about the same level results in an especially space saving embodiment of the present invention. The second support arm 13 can be provided as a lever angled downwardly where the downwardly angled part 19 of the support arm 13 is movable in a recess 23 of the column 1 between two column parts 24 forming the platforms 8 for the bearing support provisions 10 of the upwardly angled support lever 12.

The downwardly angled support arm 13 can be actuated based on a position adjustment provision 20 disposed above. The upwardly angled support arm 13 can be actuated by a position adjustment provision disposed below or, alternatively, above. At least one ladle support 15 of the ladle support arms 12, 13 can be provided with an inclination measurement sensor, which is connected to the setting provision 32 of the ladle support 15 via a control provision 35. The setting provision 32 can be provided as a hydraulic pressure cylinder. The setting provisions 32 can be disposed inside the hollow formed ends 14 of the support arms 12, 13. The ladle support 15 can be provided with an extension 33 running vertically downwardly beyond the horizontal axis 31 and the setting provision 32 is hinged to the free end of the extension 33.

Figure 2:
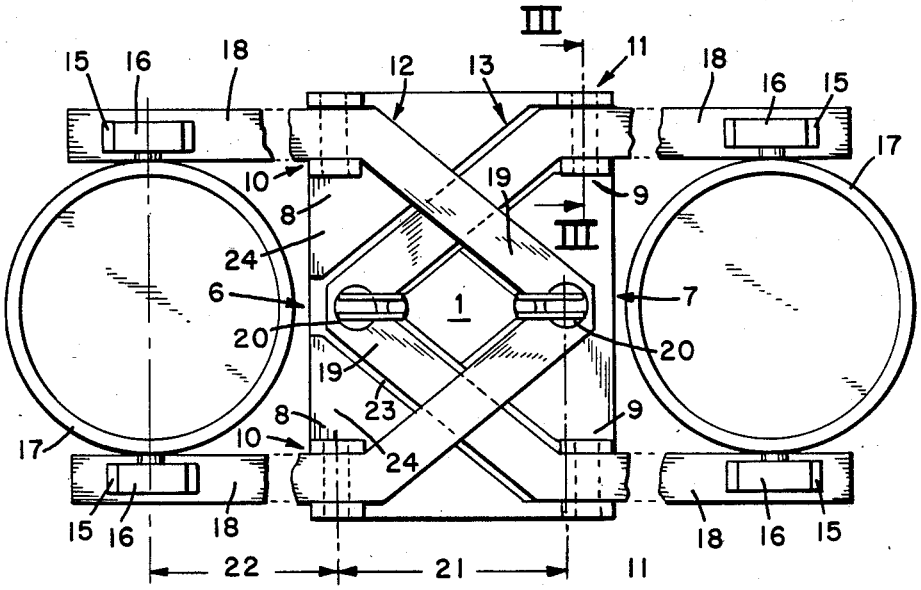
FIG. 2 is a planar view of a schematic projection representation of the ladle support tower according to FIG. 1.

The inclination of the ladle support 15 can be measured and the setting provision can be actuated via a control provision depending on the measurement result. This construction assures a particularly simple mounting and demounting of the support arms. The ladle support tower for a continuous casting plant can be provided with a support arm disposed at a column and pivoted around a horizontal axis. Ladle supports for a casting ladle can be furnished at the free ends of the support arm, where the the ladle supports in each case are supported tiltable around a horizontal axis at the support arm and where the ladle supports can be kept in a spacially constant direction by a tilting provision. At least one ladle support 15 of the ladle support arm 12, 13 can be provided with an inclination measurement sensor 34, which is connected to the setting provisions 32 of the ladle supports 15 via a control provision 35. In detail, the embodiment of FIG. 1 shows a column 1, which can be rotated around its vertical axis 2 versus the foundation base 3 via a bearing 4. Platforms 8, 9 are disposed at this column 1 at opposite sides of the column 1 and at about the same level. These platforms 8, 9 can be provided by brackets or consoles furnished at the column 1. The bearing support provisions 10, 11 for the support arms 12, 13 can be disposed at the platforms 8, 9. Each of the two oppositely disposed support arms 12, 13 is supported based on two bearing support provisions 10 or, respectively, 11 disposed at a side 6 or respectively 7, which in each case together define a horizontal axis. In each case the support arms 12, 13 are formed as levers tiltable in a vertical plane and they carry at their free ends 14 ladle supports 15, at which the support clips 16 of a ladle 17 can be placed to catch. The two support arms 12, 13 are as shown in FIG. 2 provided with the same planar projection form. In fact, they have a U-shaped form. In each case they are formed by two legs 18 disposed about parallel relative to each other and a yoke 19 connects the legs 18 and the yoke surrounds the column 1. In each case a ladle support 15 is disposed at a free end of the leg 18. Each leg 18 is supported based on its own bearing support provision 10, 11 at its side 6, 7 of the column 1 disposed toward the ladle support 15. The position adjustment provision required for the tilting motion of the support arms 12, 13 is preferably provided as hydraulic pressure cylinders 20. The hydraulic pressure cylinders 20 in each case are hinged at the side 7 or, respectively, 6 of the column 1 disposed opposite to the ladle supports 15 as well as the yoke 19 connecting the legs 18.

The length 21 of the power arm, that is, of the yoke 19, can be provided of about the same length as the length 22 of the work arm, that is, of the leg 18, by having the support arms 12, 13 surround the column 1 with their yoke 19. This allows that the hydraulic pressure cylinders 20 do not have to exert substantially more force at the yoke than the weight of the ladle 17 including contents.

As can be recognized from FIG. 1, the left support arm 12 is provided as an upwardly angled angle lever and the right support arm 13 is provided as a downwardly angled angle lever, where the position adjustment provisions 20 serving to pivot the support arms are provided in each case above the yoke 19.

The about V-shaped yoke 19 of the support arm 13 angled downwardly is movable in a recess 23 of the column 1 between the two column parts 24 forming the platforms 8 for the bearing support provision 10 of the upwardly inclined support arm 12.

The bearing support provisions of the legs according to FIG. 3 are provided by a bearing pin or shaft 25, which is rigidly inserted in each case in the legs 18 furnished as box beams by welding or by a fastening pin. In each case the bearing pin 25 is supported at its two ends by antifriction bearings 26, and preferably by spherical roller bearings in separately formed bearing cases 27, which are mounted at the platforms 8 or, respectively, 9 of the column 1. One bearing of each bearing pin 25 is provided as a movable bearing and the second bearing is provided as a fixed bearing. This embodiment allows a particularly simple assembly and disassembly of the bearing 26 as well as of the support arms 12, 13, where after the release of the hinge positions of the hydraulic pressure cylinders 20 only the covers 27' of the bearing cases 27 have to be removed.

According to FIG. 4, a bearing pin 25 is rigidly mounted at support provisions 28 attached on the platform 8 or, respectively, 9 of the column 1. It passes through the leg 18, where the leg 18 is supported versus the bearing pin 25 by antifriction bearing such as for example in the self-aligning radial roller bearing 26. The self-aligning radial roller bearings 26 are fixed versus each other by spacer bushings 29 and they are sealed to the outside by bearing covers 30. After releasing of the upper part 28' of the support provisions 28 and of one hinge position of the hydraulic pressure cylinder 20 one support arm 12 or, respectively, 13 can be lifted up together with a bearing pin 25.

The ladle supports 15 are in each case supported pivotably around a horizontal axis at the ends 14 of the legs, where a tilting motion can be performed based on a tilting provision 32, which is preferably provided as a hydraulic pressure cylinder. The tilting provision 32 is hinged at an extension 33 of the ladle support running vertically downward beyond the axis 31. An inclination meter 34 is mounted to the ladle support 15. The inclination meter 34 controls the tilting provision 32 in each case with a control provision 35 such that the ladle support 15 is directed horizontally with its support surface 36 supporting the suspension clips 16. The horizontal position is independent of the tilting position taken by the support arm 12 or, respectively, 13 around the bearing support provisions 10 or, respectively, 11. Detent stops 37 are provided at the legs 18 on the two sides of the extension 33 of the ladle supports 15, which limit the tilting motion of the ladle supports 15 around their horizontal axis 31.

This particular embodiment of the ladle supports, which assures an accurate vertical position of the ladles 17 supported by the support arms 12, 13 for any tilting position of the support arms 12, 13, not only allows for a protected disposition of the tilting provision 32 within the hollow formed legs 18 of the support arms 12 and 13, but it also assures in addition to the simple construction of the support arm, which support arm in conventional constructions is interfered with by guides, these guides being hinged to the column for the purpose of the vertical positioning of the ladles.

Figure 5:
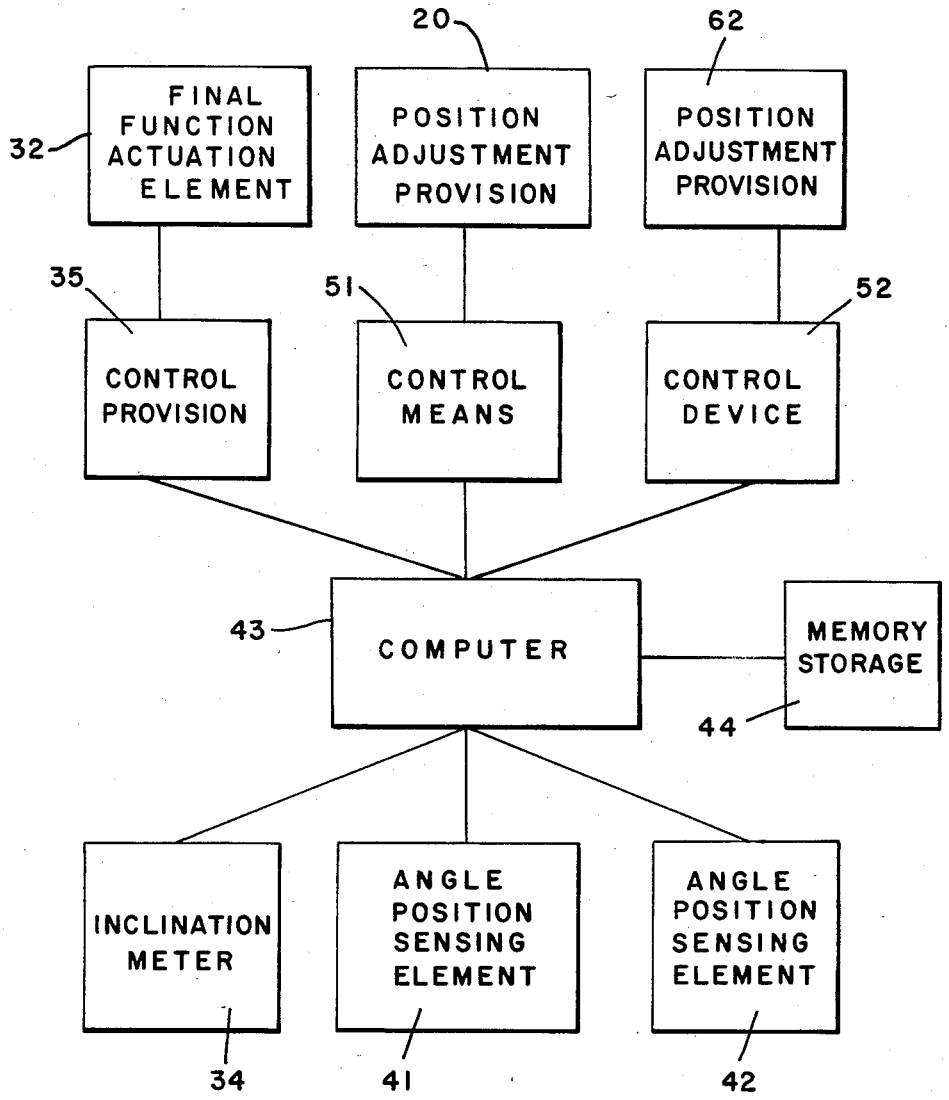
FIG. 5 is a schematic block diagram illustrating the control of the motion of the ladle support.

The energy supply required for the tilting provision 32 and the inclination meter 34 can be interrupted during disassembly of a support arm using plug connections not shown here. While FIG. 1 shows an inclination meter 34 and a control provision 35 for a final function actuation element 32 to control the angular direction of the ladle, it is also possible to control the tilting of the arms 12, 13 and the rotation of the column 1 in a similar way. As shown in the block diagram of FIG. 5, a first angle position sensing element 41 can be provided for the support arm 12, 13 and a second angle position sensing element 42 can be provided to sense the rotary position of the column. A control means 51 can be connected to the position adjustment provision to control the position of the support arm 12, 13. A second position adjustment provision 62 provided for example by an electric motor and controlled by a control device 52 can be employed to rotate the column 1. The control provision 35, the control means 51 and the control device 52 are in turn controlled by the inclination measurement sensor, the first angle position sensor 41 and, respectively, the second angle position sensor 42. Preferably, a microprocessor in a microcomputer 43 coordinates the inputs of the control provision 35, the control means 51, and the control device 52 depending on the incoming signals from the inclination measurement sensor 34, the first angle position sensor 41 and the second angle position sensor 42 and is interposed between the corresponding sensor and control elements. In addition, a memory storage 44 can be provided which is connected to the microcomputer and which comprises programs for automatically moving the ladle along a predefined path and over a predefined spacial direction sequence as desired.

It will be understood that each of the elements described above, or two or more together, may also find a useful application in other types of ladle system configurations and melt processing procedures differing from the type described above. While the invention has been illustrated and described as embodied in the context of a ladle support machine to be employed in continuous casting, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A ladle support tower for a continuous casting plant comprising a rotatable column;

a ladle support arm pivoted around a horizontal axis and including a yoke surrounding the rotatable column and having a U-shaped planar projection, and two lever legs running about in parallel and each extending an end of the yoke;

a ladle support disposed near an end of each lever leg;

a support means for each lever leg disposed between the ladle support and the yoke for supporting the lever leg on the side of the column disposed toward the corresponding ladle; and a position adjustment provision attached to the rotatable column, disposed at the side of the column opposite to the corresponding support provisions and engaging the yoke.

2. The ladle support tower for a continuous casting plant according to claim 1 wherein the support provision includes a platform attached to the column, a bearing mounted to the platform, and a bearing pin rigidly attached at the lever leg, which bearing pin is rotatably disposed at bearings mounted at a platform of the column.

3. The ladle support tower for a continuous casting plant according to claim 1 wherein the support provision includes a platform attached to the column, a bearing mounted to the lever leg, a bearing pin rigidly supported at the platform, passing through in each case a lever leg, and supported by the bearing mounted to the lever leg.

4. The ladle support tower for a continuous casting plant according to claim 1 comprising two ladle support arms such that the lever legs can be disposed about in parallel.

5. The ladle support tower for a continuous casting plant according to claim 4 wherein the support provision includes a platform for each ladle support arm;

where the platforms are disposed at about the same horizontal level;

where one of the ladle support arms has the yoke angled upwardly versus the respective lever leg plane; where a second of the support arms has the yoke angled downwardly versus the respective lever leg plane; where the downwardly angled yoke is movable in a free space provided at the column between two column parts forming the platforms for the support provision of the upwardly angled yoke.

6. The ladle support tower for a continuous casting plant according to claim 5 wherein the downwardly angled ladle support arm is actuated with a position setting provision disposed above the yoke.

7. The ladle support tower for a continuous casting plant according to claim 5 wherein the upwardly angled ladle support arm is actuated with a position setting provision disposed above the arm.

8. The ladle support tower for a continuous casting plant according to claim 5 wherein the upwardly angled ladle support arm is actuated with a position setting provision disposed below the arm.

9. The ladle support tower for a continuous casting plant according to claim 4 wherein each support provision includes a platform for each ladle support arm;

the platforms are disposed at about the same horizontal level; and a recess is provided in the column to provide space for the movement of the yokes.

10. The ladle support tower for a continuous casting plant according to claim 4 further comprising setting provisions of the ladle support disposed near an end of the lever leg;

an inclination measurement sensor disposed at one ladle support of the ladle support arm, which is connected via a control provision to the setting provisions of the ladle support.

11. The ladle support tower for a continuous casting plant according to claim 10 wherein the setting provisions include a hydraulic pressure cylinder.

12. The ladle support tower for a continuous casting plant according to claim 10 wherein the setting provisions are disposed inside of hollow recesses of the support arms.

13. The ladle support tower for a continuous casting plant according to claim 10 further comprising an extension provided at the ladle support, where the free end of the extension is hinged to the setting provision.

14. A ladle support tower for a continuous casting plant comprising a support column;

a yoke disposed at the column, having a U shaped planar projection;

a hinge mechanism disposed at the yoke for tilting the yoke around a horizontal axis;

two lever legs running about in parallel and each extending an end of the yoke;

a ladle support disposed near an end of each lever leg;

a support means for each lever leg disposed between the ladle support and the yoke for supporting the lever leg on the side of the column disposed toward the corresponding ladle;

an inclination measurement sensor disposed at the ladle support of the ladle support arm;

a control provision connected to the inclination measurement sensor; and setting provision for the ladle support connected to the control provision for maintaining the ladle support in a desired position.

15. The ladle support tower for a continuous casting plant according to claim 14 wherein the setting provision includes a hydraulic pressure cylinder.

16. The ladle support tower for a continuous casting plant according to claim 14 wherein the setting provision is disposed inside of a hollow recess of the lever leg.

17. The ladle support tower for a continuous casting plant according to claim 14 further comprising an extension provided at the ladle support, where the free end of the extension is hinged to the setting provision.

18. The ladle support tower for a continuous casting plant according to claim 14 further comprising a support provision disposed at the column for the lever leg to allow for pivoting of the lever leg around a horizontal axis;

a position adjustment provision to adjust the position of the lever leg;

control means connected to the position adjustment provision to actuate the position adjustment provision.

19. The ladle support tower for a continuous casting plant according to claim 18 further comprising coordinating means to coordinate the control means and the control provision for coordinating a change in spacial location of the ladle support to a change in the alignment direction of the ladle support relative to the column.

20. The ladle support tower for a continuous casting plant according to claim 18 further comprising a foundation base;

a rotary bearing for the support column for allowing rotation of the support column around a vertical axis relative to the foundation base;

a control device for actuating a rotation of the column; coordinating means to coordinate the control means, the control provision and the control device for coordinating a change in spacial location of the ladle support to a change in the alignment direction of the ladle support relative to the foundation base.

21. A method for operating a ladle at a ladle support tower in a continuous casting plant comprising sensing the inclination of a ladle support disposed at a ladle support arm with an inclination measurement sensor, where the ladle support arm has the shape of a yoke surrounding the rotatable column and having a U-shaped planar projection and where two support arms are running about in parallel and each extending an end of the yoke with a ladle support disposed near an end of each support arm and where a support means for each support arm is disposed between the ladle support and the yoke for supporting the support arm on the side of the column disposed toward the corresponding ladle;

feeding the signal from the inclination measurement sensor to a control provision; and actuating a motion of the ladle support with the control provision.

22. The method for operating a ladle at a ladle support tower in a continuous casting plant according to claim 21 further comprising moving fluid in a pressure cylinder to provide for actuation of the ladle support around a hinge mechanism.

23. The method for operating a ladle at a ladle support tower in a continuous casting plant according to claim 21 further comprising feeding a signal to a control means for actuating a position adjustment provision; rotating the support arm, which is disposed at a ladle support column, around a horizontal axis with the position adjustment provision.

24. The method for operating a ladle at a ladle support tower in a continuous casting plant according to claim 23 further comprising coordinating the control means and the control provision with a coordinating means for coordinating a change in spacial location of the ladle support to a change in the alignment direction of the ladle support relative to the column.

25. The method for operating a ladle at a ladle support tower in a continuous casting plant according to claim 23 further comprising feeding a control signal to a control device;

rotating the support column relative to a foundation base around a vertical axis and actuated by the control device;

coordinating the control means, the control provision and the control device with a coordinating means for coordinating a change in spacial location of the ladle support to a change in the alignment direction of the ladle support relative to the foundation base.

* * * * *